United States Patent [19]

Reynolds

[11] Patent Number: 4,915,160

[45] Date of Patent: Apr. 10, 1990

[54] APPARATUS FOR AND A METHOD OF PRODUCING MOULDING SAND FOR MOULDS

[75] Inventor: Herbert W. Reynolds, Launceston, Australia

[73] Assignee: Monica Diana Reynolds, Launceston, Australia; a part interest

[21] Appl. No.: 268,050

[22] Filed: Nov. 7, 1988

[30] Foreign Application Priority Data

Nov. 12, 1987 [AU] Australia ..... PI5383

[51] Int. Cl.[4] ..... B22C 5/04; B22C 5/18

[52] U.S. Cl. ..... 164/456; 164/6; 164/154; 366/132; 366/152; 366/161

[58] Field of Search ..... 164/456, 6, 154; 366/132, 161, 134, 152, 177

[56] References Cited

U.S. PATENT DOCUMENTS

| | | | |
|---|---|---|---|
| 3,494,412 | 2/1970 | Abraham | 164/154 |
| 3,958,795 | 5/1976 | Boenisch | 366/177 X |
| 3,966,174 | 6/1976 | Deve | 366/177 |
| 4,121,646 | 10/1978 | Rikker | 164/456 |
| 4,304,286 | 12/1981 | Waldron | 164/154 X |
| 4,598,759 | 7/1986 | Allread et al. | 164/456 X |

FOREIGN PATENT DOCUMENTS

| | | | |
|---|---|---|---|
| 56-146728 | 11/1981 | Japan | 164/456 |
| 60-94130 | 5/1985 | Japan | 164/154 |

*Primary Examiner*—Nicholas P. Godici
*Assistant Examiner*—J. Reed Batten, Jr.
*Attorney, Agent, or Firm*—Stevens, Davis, Miller & Mosher

[57] ABSTRACT

A mould forming mix of ingredients including sand, a binder, and a catalyst blend is produced. The catalyst blend includes at least two catalysts one of which is slow acting and the other of which is fast acting. The ratio of the fast and slow catalysts used to make up the catalyst blend depends on the time to hardening required, and the temperature of the sand. A data processor is used to combine information concerning the hardening time, the temperature, and the rate at which materials are fed to a mixing unit, and to process the information in order to operate catalyst suppliers which supply the fast and slow catalysts.

11 Claims, 5 Drawing Sheets

APPARATUS FOR AND A METHOD OF PRODUCING MOULDING SAND FOR MOULDS

INTRODUCTION

This invention relates to the production of sand moulds for use in casting metal articles from molten metal. More particularly the invention relates to the mixing of sand, binder and hardener to produce a homogeneous mix suitable for moulding having a preselected hardening time.

BACKGROUND TO THE INVENTION

One method of producing sand moulds for use in the casting of metal articles is to mix together sand, binder and hardener in predetermined quantities to produce a mix which spontaneously hardens after a Preselected time to thereby produce a usable mould. A problem with prior art operations has been to select the ratios and/or types of hardener and binder to produce a mix which will harden after an accurately predictable time lapse. The predictability of the time to hardening is important for the proper running and management of a casting program. Where misjudgements are made in the mix ratios wastings of mould material or castings can result which is both undesirable and decreases the efficiency of the casting operation.

A method of controlling the time to hardening has been to produce hardener in different blends, each different blend having a different hardening time. An operator then selects the blend of hardener designed to produce a time to hardening which he requires for a particular operation. The time to hardening however also varies in accordance with the temperature of the sand, the binder and the ambient air, and thus, accurate prediction of the time a particular mix will take to harden becomes difficult. This problem is exacerbated due to the fact that the sand is usually pre-treated prior to mixing by, for example, washing and drying resulting in a wide range of sand temperatures.

A skilled operator having a reasonable range of hardener blends available to him will, with some trial and error, obtain a mix which hardens after the desired time lapse. However, changes to the sand and/or air temperature can change the hardening time, and where the desired time to hardening changes, the trial and error procedure must be redone resulting once again in wastage.

A further problem with prior art systems occurs because catalysts at opposite ends of the setting time range given by a particular family, may have different optimum addition rates with respect to the amount of binder being used in the sand. In the prior art situation, a range of pre-mixed catalyst blends would be available, consisting of two catalysts mixed in various proportions, and probably also each of those catalysts alone. A foundry would stock a sufficient number of these blends to accommodate, albeit with inconvenience, the range of conditions most likely to be experienced.

The generally used pumping mechanism in the prior art cannot be adjusted simply and reproducibly to new pumping rates. Also, the use of a moderately greater-than-optimum rate of addition of catalyst does not significantly alter the hardening characteristics of the sand but it is of course a direct waste of an expensive consumable. The use of a moderately less-than-optimum rate of addition, on the other hand, results in inadequate hardening, and is a condition to be avoided. The 'optimum' rate of addition is of course that rate at which the onset of inadequate hardening is imminent.

Hence prior art systems require, because of what is practicable on the shop floor, catalyst to be added at whatever is the highest rate among the various blends that might be required; this is the only safe course to follow. It wastes material under some conditions in order not to have an inadequacy under other conditions. Clearly this is undesirable.

It is an object of this invention to provide a method of and apparatus for accurately and automatically producing a mould mix which hardens after a preselected time.

A further object of the invention is to provide means for determining and supplying an optimum ratio of catalyst mix to binder, given that a range of catalyst mixes will be used with varying conditions in use.

SUMMARY OF THE INVENTION

According to one aspect of the invention there is provided apparatus for producing a mould forming mix of ingredients including a matrix such as sand, a binder, and a catalyst blend comprised of first and second catalysts, said apparatus including feed rate determining means for determining the rate at which at least one of those ingredients is fed to a mixing chamber, at any one time, temperature sensing means operative to sense the temperature on a continuing basis of said matrix as that material is being supplied, hardening time control means operable to select a hardening time for said mix, first and second catalyst feed means operable to feed said first and second catalysts at variable rates, and catalyst mix control means responsive to information gained from said feed rate determining means, said temperature sensing means and said hardening time control means to automatically establish and control the relative rates at which said first and second catalyst feed means supply said first and second catalysts respectively to result in a ratio of ingredients which will harden at a rate compatible with said selected hardening time.

According to a second aspect of the invention there is provided a method of producing a mould forming mix including the steps of:

- separately feeding each of a plurality of mix ingredients to a mixing chamber, said ingredients including a matrix material such as sand, a binder, and at least first and second catalysts, said first catalyst being a relatively fast acting catalyst and said second catalyst being a relatively slow acting catalyst,
- determining the rate at which at least the binder or matrix is fed to said mixing chamber,
- determining on a continuing basis the temperature at which said matrix is fed to said mixing chamber,
- selecting a hardening time for said mould forming mix with a hardening time control means, and
- automatically controlling the rate and proportion at which each of said first and second catalysts are fed to said mixer by means of a catalyst mix control means,
- said catalyst mix control means being automatically responsive to said rate, temperature and hardening time information so that the resultant mix in said mixing chamber will harden at a rate compatible with said selected hardening time.

BRIEF DESCRIPTION OF THE DRAWINGS

In an example of the invention described below, reference is made to the accompanying drawings. The drawings are, however, merely illustrative of how the invention might be put into effect, so that the specific results obtained from the trials conducted in the example are not to be considered as being limiting on the invention.

In the drawings.

DETAILED DESCRIPTION OF PREFERRED EMBODIMENTS

Figure 1:
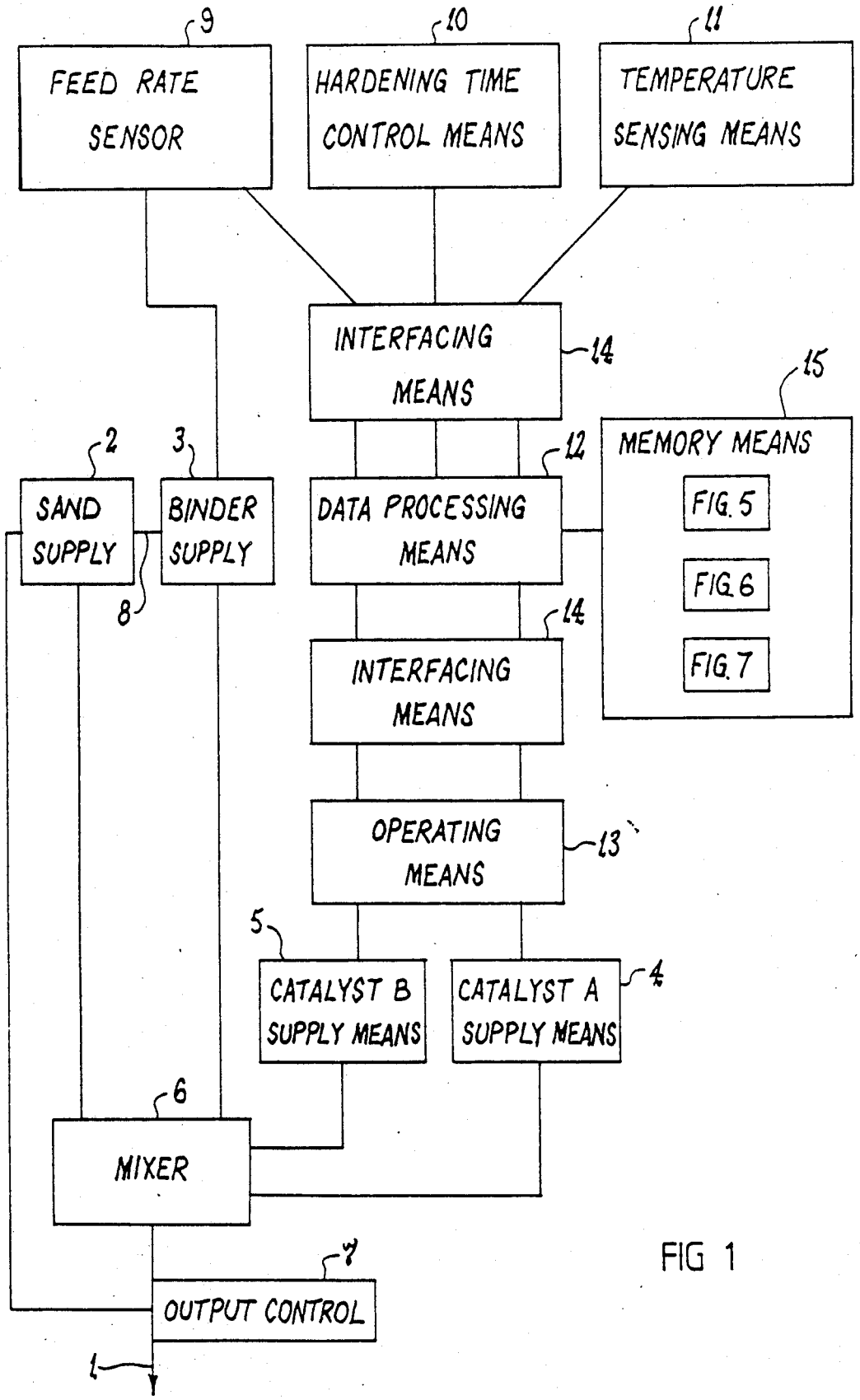
FIG. 1 shows in block diagram form the major components which comprise the apparatus of the invention, connected into a mould forming plant.

Referring initially to FIG. 1, the major components which comprise the apparatus of the invention are shown. These components will be discussed more fully below and FIG. 1 is intended simply to show an example form of the interconnection of components.

Moulds are produced from a mix of a matrix, which is usually sand, binder, and catalyst blend which is supplied through output 1. Sand is supplied from sand feed means 2, binder is supplied through binder feed means 3, and catalyst is supplied generally in a blend, by two catalyst feed means, numbered 4 and 5. Catalyst feed means 4 supplies catalyst A which is a relatively fast acting catalyst, and catalyst feed means 5 supplies catalyst B which is a relatively slow acting catalyst. The sand, binder and catalyst blend is mixed in a mixer 6 and the rate at which the mix is discharged through the output 1 is controlled by means of an output control 7.

The rate at which binder is supplied is directly proportional to the rate at which sand is supplied and accordingly there is a cross-link, indicated at numberal 8, between sand feed means 2 and binder feed means 3. The binder feed rate is thus determinable, and the determined binder feed rate is indicated by block 9 in FIG. 1.

The required hardening time for sand moulds produced at output 1 is a value which must be determined by the plant operator. A hardening time control switch will be provided so that a required hardening time can be selected by the operator. The required hardening time control is indicated by block 10 in FIG. 1.

The temperature of sand, and possibly the ambient temperature, are easily measurable with suitably located probes, and the temperature so determined is indicated by block 11 in FIG. 1.

The information relating to binder feed rate, required hardening time, and temperature, is supplied to a data processing means indicated at numeral 12. The data processing means 12 will evaluate the information obtained from those three sources and determine in accordance with a pre-programmed data base and an operating algorithm the rates at which catalysts A and B are to be fed to the mixer 6 in order that the apparatus produces a mix which will harden after the desired hardening time has elapsed. Operating means 13 will be automatically instructed by the data processing means 12 to operate the catalyst feed means 4 and 5 at the required rate. Data supplied to and provided by the data processing means will pass through suitable interface means 14 as is required by the processing means. The processing means also has a memory means 15 for storage of the pre-programmed data base.

Thus, the data processing means is caused to vary the rate at which catalysts A and B are fed to the mixer 6 as a result of variations in mix demand, required hardening time, and temperature variations. The manner in which this is achieved is described more fully herebelow.

Figure 2:
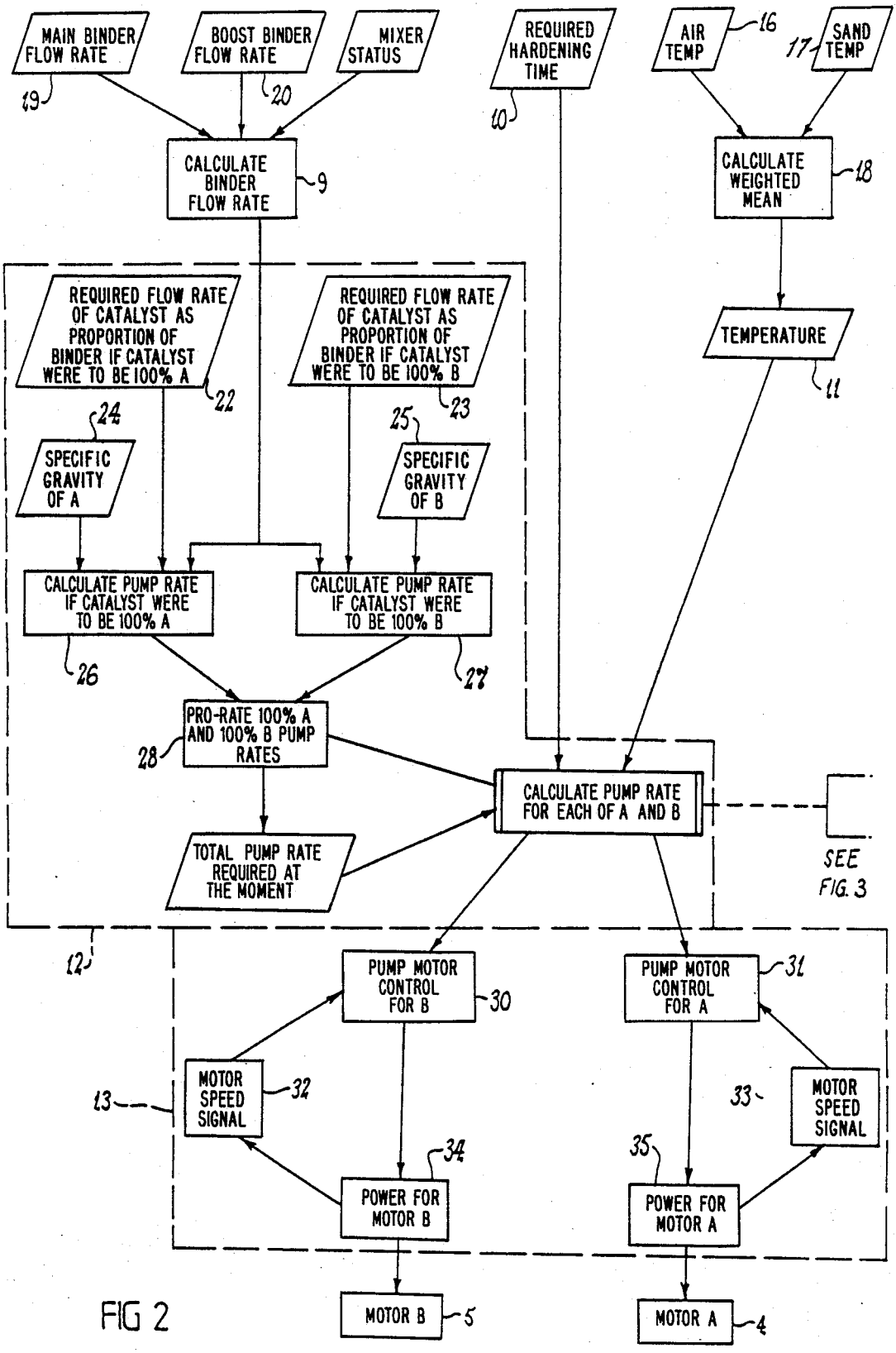
FIG. 2 shows in block diagram form the interconnection of components for carrying out the method of the invention.

FIG. 2 of the drawings depicts the data processing means 12, the operating means 13, the temperature sensing means 11 and the binder feed rate determining means 9 in more detail.

An air temperature sensor 16 and a sand temperature sensor 17 connect to a device 18 for calculating the weighted means of those two temperatures. Generally, the temperature of binder and hardener or catalyst (the words being used herein interchangeably) will be the same as ambient temperature since they are usually stored within the area wherein moulds are being formed. Sand temperature can, however, be significantly different from ambient temperature. Depending on the type and proportion of binder to sand being used within a sand binder mixer the temperature of the sand being mixed will be slightly influenced by the temperature of the binder being added thereto. The actual extent to which the mixture reflects the sand or binder temperature varies from plant to plant, and also depends to some extent on the type of binder being used. It can thus be important to provide a weighted mean temperature of the relative temperatures of sand and binder. It has been found that a weighted mean of between about 90% sand temperature to 10% ambient temperature, and 98% sand temperature to 2% ambient temperature is the range in which the optimum results will be found to occur. In any particular plant values of the weighted mean of the two temperatures will be selected and thereafter that weighted mean can be utilized for all calculations.

Electronically, a simple and accurate method of deriving a weighted mean temperature is to put a potentiometer between lines carrying voltage signals proportional to sand and air temperatures, and buffer the voltage that appears on the potentiometer wiper. This buffered output is the weighted mean. Clearly other methods of determining the weighted mean are possible. Once a weighted mean has been determined for a particular installation it will not need subsequent changing. The weighted means calculation device is shown at numeral 18 in FIG. 2. Clearly a less precise arrangement will be to simply measure only the sand temperature and use that temperature in calculations, but this arrangement is less accurate than determining the weighted mean temperature as described above. The temperature determined is indicated at numeral 11 in FIG. 1.

The required hardening time control means 10 can be any convenient form and may be a calibrated dial so as to provide for a range of settings. The selection mechanism is arranged to provide corresponding voltage signals through interface 14 to the data processing means 12.

The binder feed rate can be calculated by any convenient means and may comprise a function of a main binder feed rate sensor 19, a booster feed rate sensor 20, and a mixer sensor 21 for determining the exact rate of binder being fed to mixer 6.

The processing means 12 is adapted to accept information from the binder feed rate sensor 9, the required hardening time control 10, and the temperature sensing means 11. Clearly the manner in which this information is combined in order to operate the catalysts A and B feed means 4 and 5 in order to provide a mix which hardens after the preselected time will be determined to some extent on the form of the data processing means 12.

In the following example a data processing means is described which is set up with memory means having stored therein two data sets, each set relating to the time to hardening for a mix wherein catalysts A and B are used independently of each other over a range of temperatures. The two sets can be cross-related by use of a simple algorithm to determine the proportion of each catalyst to be used in a mix of predetermined hardening time. It will, however, be understood that the data processing means can be set up differently and still produce results for determining the proportions of catalyst A and B to be used in any particular mix.

EXAMPLE

This example describes how a data base was set up for one particular installation, and by obtaining an understanding of the methodology of this example, it will be a simple matter to duplicate the process for other installations. Clearly it is not intended to limit the invention to the methodology of this example and it will be apparent that for different constituents completely different data sets will be obtained.

In the example catalyst A is a mixture of ethylene carbonate and propylene carbonate marketed by Foseco as Veloset 01 (Trade Mark). Catalyst B is a mixture of propylene carbonate and ethylene glycol diacetate, marketed by Foseco as Veloset 71 (Trade Mark). Note that it is not important, where the data base is set up empirically, for the actual constituents to be known. All that is necessary will be that one constituent (A) is fast acting, and the other constituent (B) is slow acting. The two catalysts A and B are mixed together to form a catalyst blend which brings about hardening after a desired time has elapsed.

The sand used in the example is washed silica sand, with a normal grain size distribution and an A.F.S. Fineness Number of 55. The binder, sodium silicate is added at a rate of 3.5% by weight to the sand, and catalyst blend is added at 15% by weight to the sodium silicate binder.

Four catalyst blends are used: 100% A, 68.5% A+31.5% B, 30% A+70% B, and 100% B, all percentages being by weight. The time between mixing and hardening to a strength appropriate for stripping the mould from a pattern was determined for each combination of catalyst blend and temperature.

The following results were obtained:

| Temp | Catalyst | Time (minutes) | 20/time |
|---|---|---|---|
| 21 | A | 16 | 1.250 |

-continued

The following results were obtained:

| Temp | Catalyst | Time (minutes) | 20/time |
|---|---|---|---|
| 21 | 68.5% A + 31.5% B | 30 | 0.667 |
| 21 | 30% A + 70% B | 73 | 0.274 |
| 21 | B | 183 | 0.109 |
| 24.5 | A | 12 | 1.667 |
| 24.5 | 68.5% A + 31.5% B | 21 | 0.952 |
| 24.5 | 30% A + 70% B | 59 | 0.339 |
| 24.5 | B | 137 | 0.146 |
| 31 | A | 8 | 2.500 |
| 31 | 68.5% A + 31.5% B | 16 | 1.250 |
| 31 | 30% A + 70% B | 36 | 0.556 |
| 31 | B | 91 | 0.220 |
| 42 | A | 4.6 | 4.350 |
| 42 | 68.5% A + 31.5% B | 8.5 | 2.353 |
| 42 | 30% A + 70% B | 21 | 0.952 |
| 42 | B | 50 | 0.400 |

Figure 4:
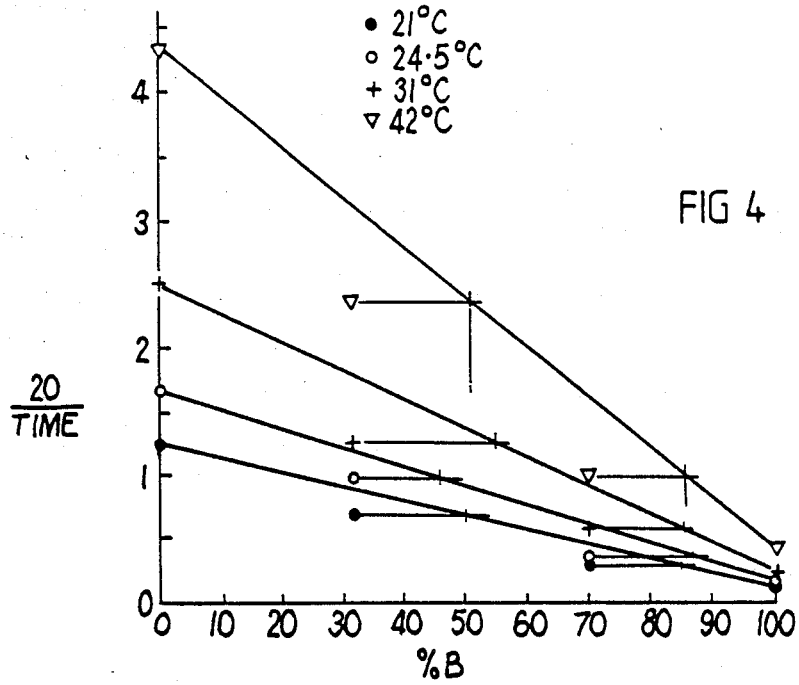
FIG. 4 shows a graph displaying hardening times for different catalyst mixes at different temperatures.

The fourth column is a simple function of time which is applied to the time result obtained in order to assist with plotting the results. These results are then utilized to provide machine readable data which can be used by the data processing means to determine the percentages of catalysts A and B to be used in any particular mix. The following is a preferred procedure:

1. For each temperature, plot 20/time as ordinate against % B as abscissa. These plots are shown in FIG. 4.
2. For each temperature join the 0%B and 100%B points with straight lines.
3. On each of these straight lines, mark the points whose ordinates are the same as are given by the two intermediate catalyst blends. Calculate the mean abscissa of each group of 4 points. Note from FIG. 4 that the mean abscissae are 51 and 86 for the two groups respectively.
4. Plot a transfer function F (see FIG. 5). The ordinates are the mean abscissa values for each group of points plotted in FIG. 4, and the abscissae are the mean abscissa values calculated in step 3 above. Thus, the points to be plotted are (0,0), (51, 31.5), (86, 70) and (100, 100). It will be noted that these values plot to the smooth curve depicted in FIG. 5. The transfer function is completely independent of temperature and when applied to any assumed rectilinear %B (k) verses 20/time line (see straight lines in FIG. 4), will generate the correct curvilinear function (b) relating %B in a catalyst blend to 20/time to hardening for sand made with that catalyst blend.
5. Plot four points of a new function [A] (see FIG. 6). Abscissae are the original test temperatures, ordinates are the 20/time values at 0%B, which can be read off FIG. 4. The points join together in a smooth curve. This gives [A], the 20/time to hardening of catalyst A, as a function of temperature.
6. Repeat the procedure of step 6 to produce a smooth curve for a function [B], being the 20/time to hardening of catalyst B as a function of temperature. FIG. 7 shows the completed curve.

Figure 5:
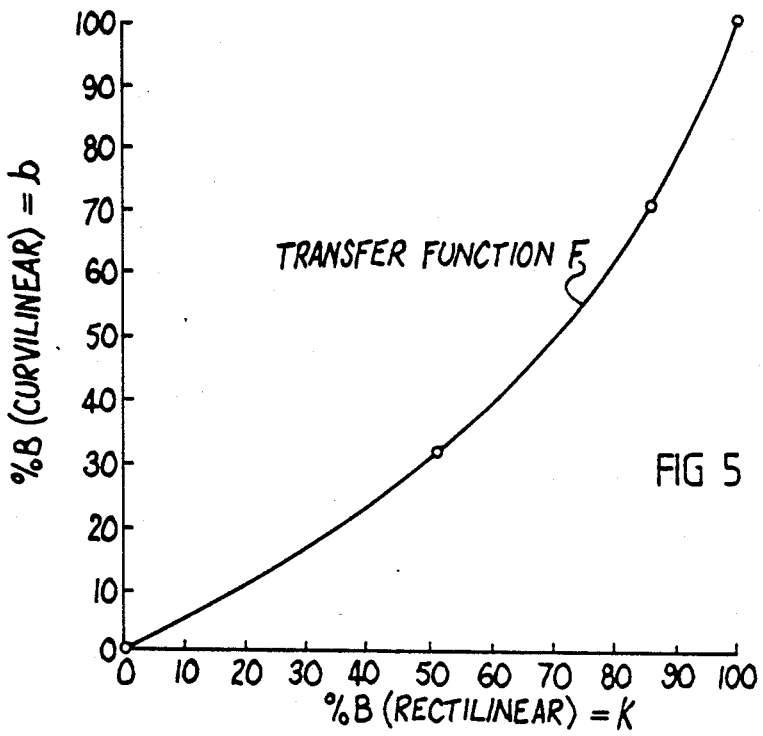
FIG. 5 shows a transfer function for relating rectilinear and curvilinear percentages of a catalyst B.
Figure 6:
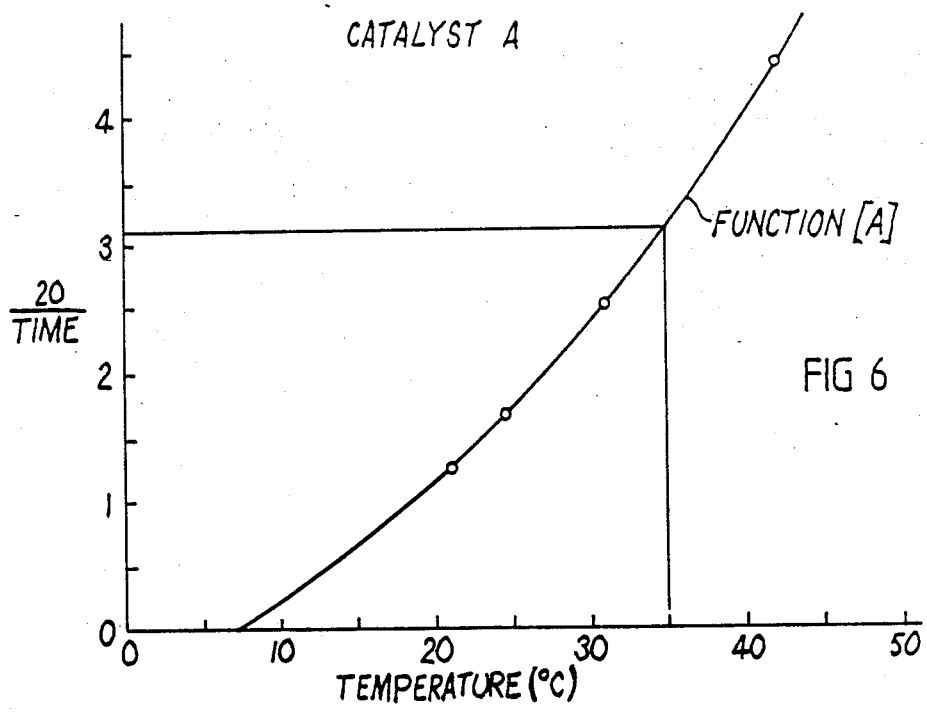
FIG. 6 shows a graph relating temperature to inverse hardening time for catalyst A.
Figure 7:
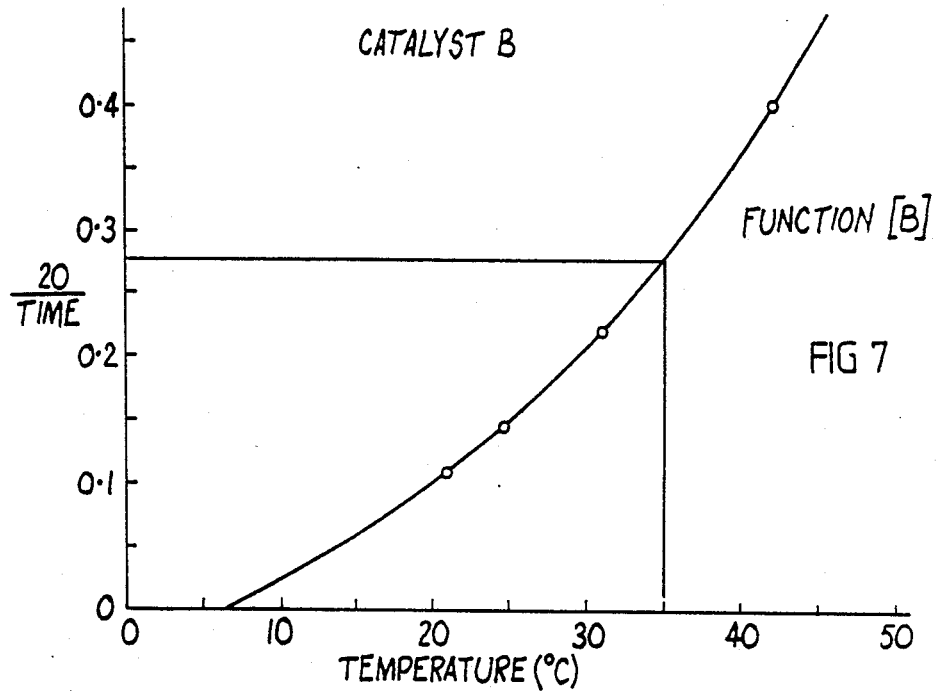
FIG. 7 shows a graph relating temperature to inverse hardening time for catalyst B.

Each of the curves shown in FIGS. 5, 6 and 7 can be easily stored in the memory means 15 of the data processing means 12.

If we assume that the relationship between hardening time and catalyst blend proportions is rectilinear (as shown by straight line plots in FIG. 4) it can be shown by simple analytical geometry that [K]=k[B]+(1−k)[A] or by rearranging, $$k = \frac{[A] - [K]}{[A] - [B]} \quad (1)$$

where

[A] denotes the value of 20/time to hardening using catalyst A

[B] denotes the value of 20/time to hardening using catalyst B k denotes the percentage of B in some blend of A and B and

[K] denotes the value of 20/time to hardening using a catalyst of blend k.

If the values of [A] and [B] are determined by measuring the temperature, and [K] is determined by selecting a desired hardening time the value of k can be calculated using the expression (1).

However, we are aware that, in fact, the relationship between hardening time and catalyst blend is not rectilinear, but curvilinear. The value of k must thus be modified by the transfer function as set forth in FIG. 5 to thereby arrive at an accurate proportion of catalyst B to be used in a mix to produce a desired hardening time.

Clearly then the data processing means will receive information, via suitable interfaces, relating to temperature, binder rate, and desired hardening time, and using the data base and algorithm (1) as described above, calculate the percentage of catalyst B to be employed in the catalyst blend being fed to the mixer 6. This can be done on a continuous basis and the blend will be varied automatically as the temperature, feed rate, and selected hardening times vary.

It will be apparent that some input data items are inherently analog quantities, such as temperature, and others are inherently discontinous, such as digital switch settings for feed rates, and hardening time. The data processing means can be of either digital or analog form. It is preferred that digital data is converted to analog signal form and is then processed with other inherently analog data by circuits which constitute an analog computer, with outputs in analog form for use in controlling pumping rates. It will, however, be possible to use analog to digital converters and use digital computer circuits to provide digital type outputs. It is preferred to use analog computation for reasons such as consistency, simplicity of operation and like considerations.

Figure 3:
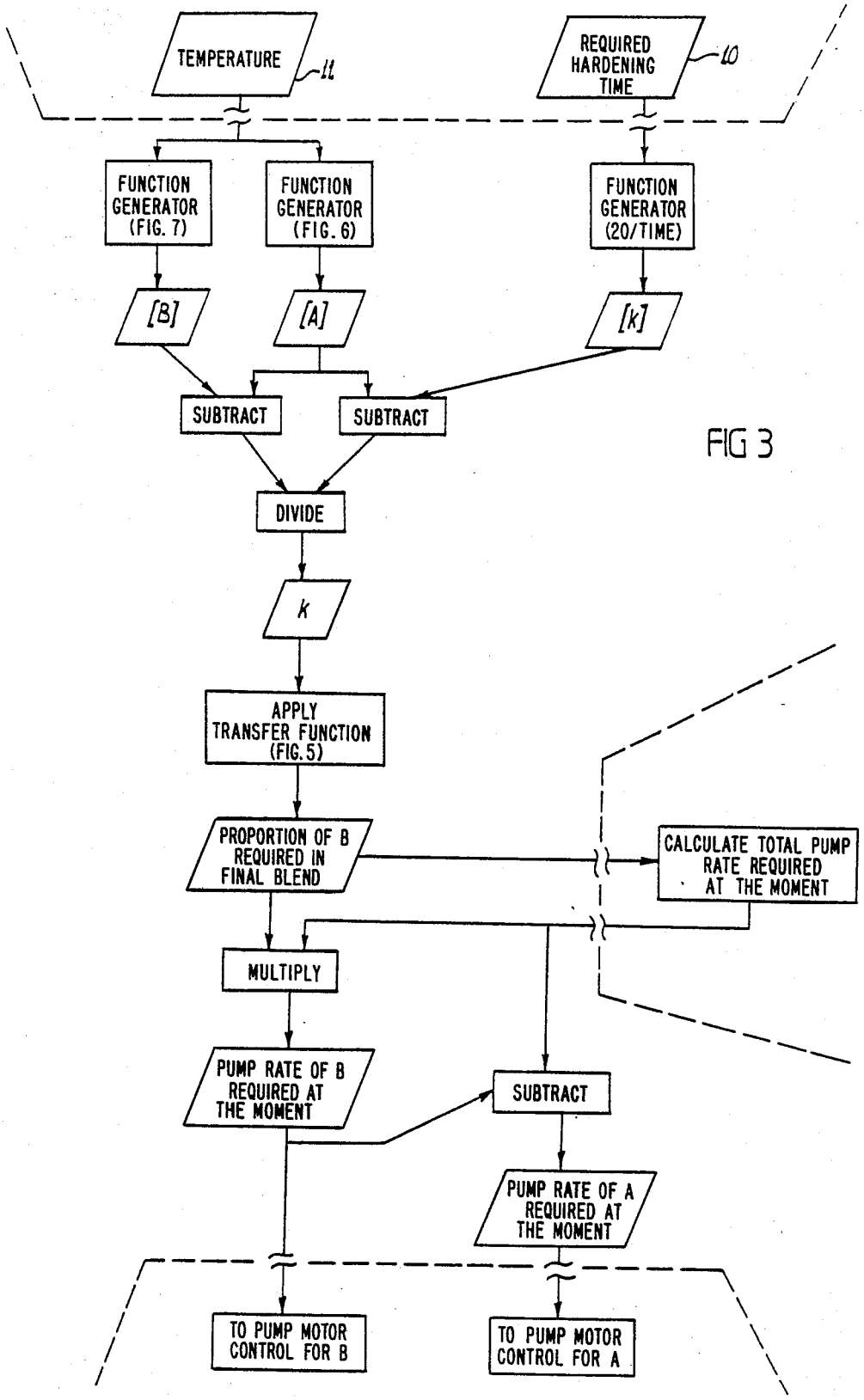
FIG. 3 shows in block diagram form part of the decision making apparatus for carrying out the method of the invention.

It is not considered necessary to further describe the data processing means or other electronic equipment since implementation of the invention from the data provided above will be relatively easily done by those skilled in the art. The functional connections of the components are shown in FIG. 3.

As mentioned in the introductory portion of this specification, it is desirable to adjust the total feed rate of catalyst blend used in any mix, depending on the relative percentages of catalysts A and B which make up that blend.

The apparatus preferably includes two separate dials or calibrated switches specifying, for each of the two raw material catalyst components A and B, the rate at which that component A or B should be added to the sand if in fact it were the only component required to be added. For example, the mix might work best where catalyst A is added at 16% by weight of binder being used, and catalyst B is best added at 13% of the weight of binder being used. It is desirable for the electronic computation circuitry to pro-rate these two feed-rate values according to the proportions of components needed at any one time. This pro-rated feed rate is what is used as the required total catalyst feed rate whenever that parameter is needed in calculations. Using the above example values, if at some moment a blend of 36%A+64%B was required in order to meet the hardening time requirement at the prevailing temperature, then this blend would be supplied at a rate of 36% of 16% plus 64% of 13%; that is, 14.08%. The product supplied to the mixer would consist of A and B in the proportions to each other of 36:64, and this blend would be supplied at a rate equal to 14.08% of the rate at which binder was being added.

In this way, this invention permits the optimum amount of catalyst to be used at all times, eliminating the economically wasteful over-use that can sometimes occur with the prior art.

Referring to FIG. 2 of these drawings, the manner in which the feed rate of catalysts A and B are varied in accordance with changing circumstances are depicted in more detail. The data Processing means 12 accepts information binder feed rate from sensor 9, hardening time from control means 10, and temperature from sensor 11. From the binder feed rate sensor 9 it is possible to calculate the catalyst blend feed rate. This is usually of the order of 15% of the binder feed rate and it will be possible to supply catalyst blend in a rate which is a fixed percentage of the binder. It is however preferred to vary the rate of supply depending on the proportions of catalysts A and B being supplied. Thus, the data processing means may include calculation means for varying the total percentage of catalyst blend supplied. The calculation means may include a data base, depicted at numerals 22 and 23 relating the feed rates of catalysts A and B respectively, if those catalysts were being used on their own. The data base would also include data, depicted at numerals 24 and 25 respectively, of the specific gravities of catalysts A and B. Thus, for any specific rate of binder being supplied the data processing means can calculate the catalyst supply rates (i.e. pump rates) as if catalysts A and B were being supplied on their own. Those calculations are depicted at numerals 26 and 27 respectively.

The data processing means will then calculate the percentages of catalysts A and B needed in the catalyst blend required at any one time. The total flow rate can then be adjusted on a pro-rate basis, depending on the percentage of each catalyst A and B in the catalyst blend. This pro-rate calculation is depicted at numeral 28.

The operating means 13 accepts information from the data processing means 12 in order to operate catalyst supply means 4 and 5. Conveniently, this may take the form of a pump motor control (30, 31) for each pump motor 4 and 5. Information (32, 33) concerning the motor speeds of each pump motor is fed back to the motor controls (30, 31) which then adjust the power (34, 35) being used to drive the pump motors 4 and 5 in accordance with the information supplied by the data processing means 12.

The mechanical supply system that is to be controlled by the outputs of the electronic processing, may consist of a number of pumps, each driven by an electric motor. There are available two basic approaches to ensuring that the quantity of material being delivered by a pump is in fact that quantity instructed by the computed signal from the data processing means. The pumps for supplying catalysts A and B are depicted by numerals 4 and 5 in FIG. 1.

One approach is to use a pump type which accurately reproduces the same delivery quantity on every operating cycle of its mechanism, and then to control the rate at which it repeats its cycle.

The other approach is be less concerned with consistency of pump performance per cycle, and append a flow-meter to the pump, to measure the rate at which material is being pumped. Such a flow-meter would produce an electrical signal that was a measure of the material flow rate, and this would be fed back to the circuit controlling the motor, to be compared with the electrical signal specifying the required flow-rate; any discrepancy would immediately cause the electronics to speed up or slow down the motor driving the pump, so as to produce a sufficiently small error between the flow required and the flow delivered.

Either method can be used. Consideration of the achievable accuracy of each method leads to the preferred method being a fixed displacement pump driven by a motor whose speed is precisely controlled. The accuracy with which the speed of a suitable motor can be controlled, is at least an order of magnitude greater than the accuracy with which any existing flow-meter can determine the flow rate of a liquid in a pipe and output a corresponding electrical signal.

Fully satisfactory results have been achieved by using pump components manufactured by Gorman-Rupp Industries, Bellville, Ohio, USA, these being components for their standard line of bellows metering pumps, assembled into constant stroke units driven directly by geared DC shunt-wound motors manufactured by Parvalux Electric Motors Ltd, Bournemouth, England (their model SD11A), via an eccentric bearing assembly on the output shaft of the motor gearbox. Such units have routinely demonstrated, in the implementation of this invention, a variation in flow rate of less than 1% over 2000 hours operation.

Other pump and or motor types could be used, of course, such as for instance a stepping motor rather than the more conventional commutator type, and accompanied by the appropriate motor control electronics.

It will be appreciated that in the above example the values for determining the hardening time have been determined empirically. It will be possible to determine the hardening time analytically if the exact chemical constituents of the mix ingredients are known and accordingly the invention is not limited to this empirical technique. As previously mentioned, the empirical technique is advantageous since the data base can be set up easily using only a limited number of tests, and thereafter where the ingredients remain the same, the apparatus will produce consistently accurate results. Where the ingredients are changed a new set of tests must be conducted. Clearly the set up procedure described herein is only one of a range of such procedures which could be used. Accordingly, the invention is not to be considered as being limited to a procedure as set out in the example.

Having now described our invention what we claim as new and desire to secure by Letters Patent is:

1. Apparatus for producing a mould forming mix of ingredients including a matrix material, a binder, and a catalyst blend comprised of first and second catalysts, said apparatus including feed rate determining means for determining the rate at which at least one of those ingredients is fed to a mixing chamber, at any one time, temperature sensing means operative to sense the temperature on a continuing basis of said matrix material as that material is being supplied, hardening time control means operable to select a hardening time for said mix, first and second catalyst feed means operable to feed said first and second catalysts at variable rates, and catalyst mix control means responsive to information gained from said feed rate determining means, said temperature sensing means and said hardening time control means to automatically establish and control the relative rates at which said first and second catalyst feed means supply said first and second catalysts respectively to result in a ratio of ingredients which will harden at a rate compatible with said selected hardening time.

2. Apparatus according to claim 1 wherein said catalyst mix control means comprises a data Processing means and a memory means, said memory means having a data base stored therein, said data base including a first data set comprising information relating to a range of temperatures and corresponding hardening times of a mixture comprising said matrix material, said binder, and said first catalyst, and a second data set comprising information relating to a range of temperatures and corresponding hardening times of a mixture comprising said matrix material, said binder and said second catalyst, said data processing means adapted to receive said information and process said information in accordance with a pre-programmed algorithm and in accordance with said data base, said data processing means being arranged to control said first and second catalyst feed means.

3. Apparatus according to claim 2 wherein said algorithm is in the form:

$$b = F(k) \text{ where } k = \frac{A - K}{A - B}$$

wherein A is a function of the hardening time which would be obtained using said first catalyst alone in a mix at said temperature determined by said temperature sensor means, B is the same function of the hardening time which would be obtained using said second catalyst alone in a mix at said temperature determined by said temperature sensor means, K is the same function of the hardening time as selected with said hardening time control means, k is an intermediate variable the value of which corresponds to the percentage of said second catalyst in a catalyst blend of said first and second catalysts which would produce a mixture which would harden after said selected hardening time at said temperature determined by said temperature sensing means, if it is assumed there exists a rectilinear relationship between the percentage of said second catalyst in said catalyst blend of said first and second catalysts and the above said function of the hardening times that actually result from respective various percentages of said second catalyst in said catalyst blend of said first and second catalysts, b is the percentage of said second catalyst in said catalyst blend of said first and second catalysts which will produce a mixture which hardens after said selected hardening time at said temperature determined by said temperature sensing means, and F is the functional relationship which yields the value for variable b from an input value for the immediate variable k, to correct for the inaccuracy in the assumption made in the calculation of k.

4. Apparatus according to claim 1 wherein said temperature sensing means is operative to sense the temperature of both the matrix material and ambient temperature, and said apparatus includes calculation means for calculating the weighted mean of said temperatures such that said calculated weighted mean is substantially the same as the temperature of said mix in said mixing chamber.

5. Apparatus according to claim 2 wherein said data base includes data relating to the optimum rate at which each catalyst is to be mixed with said binder, and said data processing means adjusts the rate at which said catalyst blend is fed to said mixing chamber in accordance with the relative percentages of said first and second catalysts in said catalyst blend.

6. Apparatus according to claim 1 wherein said first and second catalyst supply means each comprise a fixed displacement pump driven by a variable speed electric motor.

7. A method of producing a mould forming mix including the steps of:

separately feeding each of a plurality of mix ingredients to a mixing chamber, said ingredients including a matrix material, a binder, and at least first and second catalysts, said first catalyst being a relatively fast acting catalyst and said second catalyst being a relatively slow acting catalyst, determining the rate at which at least the binder or matrix material is fed to said mixing chamber, determining on a continuing basis the temperature at which said matrix material is fed to said mixing chamber, selecting a hardening time for said mould forming mix with a hardening time control means, and automatically controlling the rate and proportion at which each of said first and second catalysts are fed to said mixing chamber by means of a catalyst mix control means, said catalyst mix control means being automatically responsive to said rate, temperature and hardening time information so that the resultant mix in said mixing chamber will harden at a rate compatible with said selected hardening time.

8. A method according to claim 7 wherein said catalyst mix control means comprises a data processing means and a memory means and said method includes the steps of:

providing said memory means with a data base including a first data set comprising information relating to a range of temperatures and corresponding hardening times of a mixture comprising said matrix material, said binder and said first catalyst, a second data set comprising information relating to a range of temperatures and corresponding hardening times of a mixture comprising said matrix material binder and said second catalyst, providing said data processing means on a continuing basis with the rate at which the binder or matrix material is fed to said mixing chamber, providing the data processing means on a continuing basis with the temperature at which said matrix material is fed to said mixing chamber, providing the data processing means with information concerning the selected hardening time, repetitively calculating with the data processing means at frequent intervals the ratio of and rate at which said first and second catalysts should be supplied to said mixing chamber in order to produce said mix which hardens at said rate compatible with said selected hardening time, said calculations combining said rate, temperature and hardening time information with said data base information, and operating said catalyst mix control means to produce a catalyst blend having a ratio and rate as determined by said data processing means.

9. A method according to claim 8 wherein said data processing means is provided with an algorithm which is $$b = F(k) \text{ where } k = \frac{A - K}{A - B}$$

wherein A is a function of the hardening time which would be obtained using said first catalyst alone in a mix at said temperature determined by said temperature sensor means, B is the same function of the hardening time which would be obtained using said second catalyst alone in a mix at said temperature determined by said temperature sensor means, K is the same function of the hardening time as selected with said hardening time control means, k is an intermediate variable the value of which corresponds to the percentage of said second catalyst in a catalyst blend of said first and second catalysts which would produce a mixture which would harden after said selected hardening time at said temperature determined by said temperature sensing means, if it is assumed there exists a rectilinear relationship between the percentage of said second catalyst in said catalyst blend of said first and second catalysts and the above said function of the hardening times that actually result from respective various percentages of said second catalyst in said catalyst blend of said first and second catalysts, b is the percentage of said second catalyst in said catalyst blend of said first and second catalysts which will produce a mixture which hardens after said selected hardening time at said temperature determined by said temperature sensing means, F is the functional relationship which yields the value for variable b from an input value for the immediate variable k, to correct for the inaccuracy in the assumption made in the calculation of k, and A and B are determinable from said first and second data sets respectively, said method including the steps of repetitively calculating the values of A, B, K, and hence k, multiplying the value of k by the function F, and operating said catalyst mix control means to produce a catalyst blend wherein the percentage of said second catalyst in said blend is equal to b.

10. A method according to claim 7 including the steps of determining on a continuing basis the ambient temperature and automatically calculating the weighted mean of said matrix material and ambient temperatures to thereby accurately determine the temperature of the mix in the mixing chamber, said catalyst mix control means being automatically responsive to said weighted mean temperature information to provide said resultant mix.

11. A method according to claim 8 including the steps of providing the data base with data relating to the optimum rate at which each catalyst is to be mixed with said binder, and automatically operating said data processing means to adjust the rate at which said catalyst blend is fed to said mixing chamber in accordance with the relative percentages of said first and second catalysts in said catalyst blend.

* * * * *